United States Patent [19]

Hunt et al.

[11] 4,228,639

[45] Oct. 21, 1980

[54] PRODUCTION OF YARN

[75] Inventors: Robert J. Hunt, Lisburn; Norman A. Hill, Belfast, both of Ireland

[73] Assignee: James Mackie & Sons Limited, Belfast, Northern Ireland

[21] Appl. No.: 55,810

[22] Filed: Jul. 9, 1979

[30] Foreign Application Priority Data

Jul. 19, 1978 [GB] United Kingdom ..... 30288/78

[51] Int. Cl.[3] ..... D01H 7/88; D01H 7/92; D02G 3/38

[52] U.S. Cl. ..... 57/16; 57/341

[58] Field of Search ..... 57/3, 6, 13, 14, 15, 57/16, 17, 18, 315, 328, 324, 331, 341, 342

[56] References Cited

U.S. PATENT DOCUMENTS

| | | | |
|---|---|---|---|
| 3,166,885 | 1/1965 | Bridgeman et al. | 57/16 X |
| 3,527,045 | 9/1970 | Wilson | 57/16 X |
| 3,570,233 | 3/1971 | Nalpas et al. | 57/16 |
| 3,717,959 | 2/1973 | Chatin | 57/16 |
| 3,868,812 | 3/1975 | Chatin | 57/16 |

*Primary Examiner*—Donald Watkins

*Attorney, Agent, or Firm*—Larson, Taylor and Hinds

[57] ABSTRACT

In order to produce core yarn wrapped with at least two separate wrapper yarns of the same or opposite hands, core material is passed in succession through a pair of rotary hollow spindles, each carrying a package of wrapper yarn whereby the core material is wrapped and which are relatively displaced so that the path of the material between a point just before the entrance of the first spindle and a point just after the exit of the second spindle deviates from a straight line so as to cause the core material or the resultant yarn to engage a rotary end of at least one of the spindles so as to apply false twist. The spindles may be supported so that their axes are displaced or displaceable in relation to one another for which purpose each spindle may be carried by a mounting capable of angular displacement about a support shaft and capable of being secured in any one of a range of angular positions. The apparatus may also include a take-up roller or rollers and a pair of intermediate rollers between the exit of the first spindle and the take-up roller or rollers.

16 Claims, 7 Drawing Figures

PRODUCTION OF YARN

Figure 1:
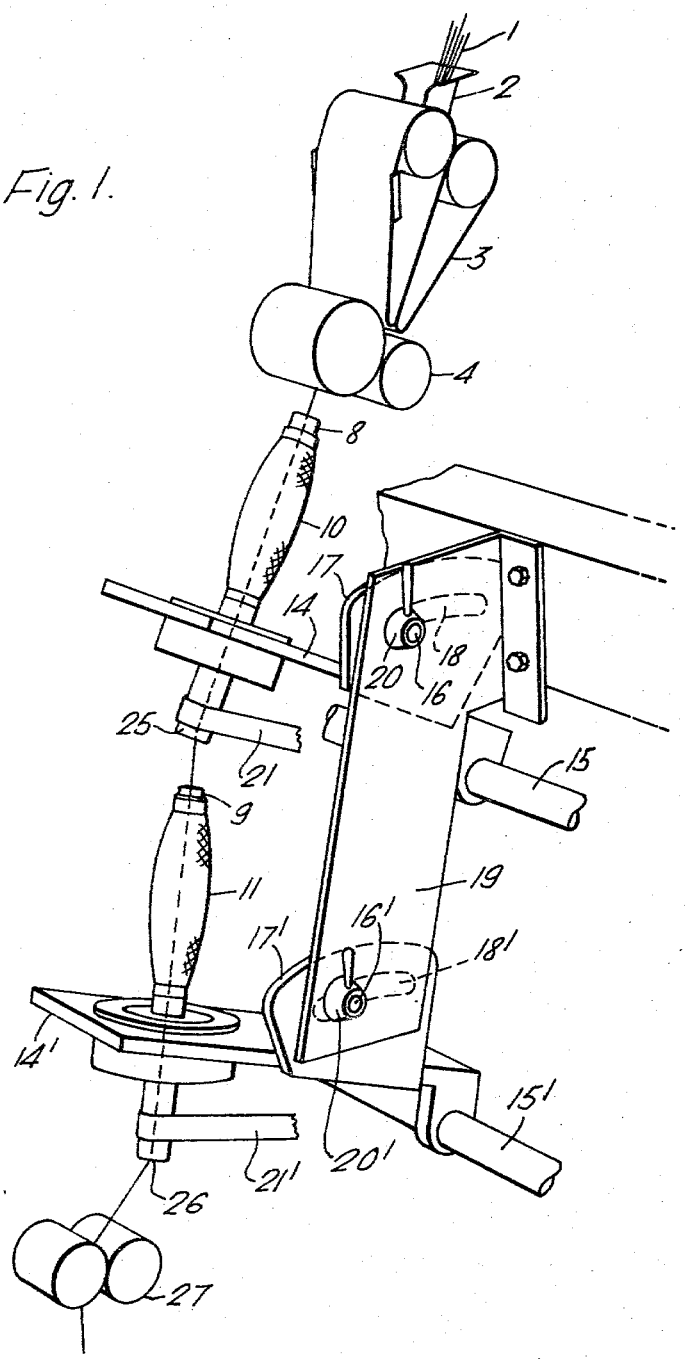

The so-called process of wrap spinning involves passing a core of textile material through a hollow spindle which supports a package of wrapper yarn. The wrapper yarn is also passed through the spindle with the core so as to be withdrawn overend from the package and to be wound around the core in a helical path to bind the core together to form a coherent yarn, the pitch of the helices being controlled by the speed of the spindle. The core material may take various forms, but most commonly is constituted by a sliver delivered directly from a drawing head so that the fibres proceed directly from the delivery rollers of the head to the wrapping point. The binding material, referred to above as the wrapper yarn, need not strictly be a yarn at all and may comprise, for example, mono- or multi-filaments, natural or synthetic yarns, tapes, wires and so forth. In addition to the production of a straightforward core yarn, the same principle of operation can be used so as to give a slub or effect yarn by passing effect material along with the core material through the spindle, the effect material being overfed in relation to the core material.

Wrap yarn produced in this way can be used for a variety of purposes and its characteristics can be varied as required. In particular, a wide selection of materials can be used for the core material and wrapper yarn and when an effect yarn is desired, even more variations are possible. Generally speaking, it is desirable to apply false twist to the core material so that the core is in a twisted state at the wrapping point. This false twist can be applied in a variety of ways, e.g. by a separate false twist device, by engagement of the core material with the rotary entry end of the spindle or by engagement with the rotary exit end of the spindle. When the overall strength of the yarn is a primary consideration, it may be necessary to apply more than one wrapper yarn by passing the core material in succession through two or more hollow spindles. If just two wrapper yarns are used, they may be wound with the same or opposite hands, the latter generally providing a somewhat greater strengthening effect. The present invention is concerned with yarns of this type, that is to say wrapped with at least two separate wrapper yarns of the same or opposite hands.

According to the invention, such a yarn is produced by passing the core material in succession through a number of rotary hollow spindles, at least two of which each carry a package of wrapper yarn whereby the core material is wrapped, the path of the material between a point just before the entrance of the first spindle and the exit of the last spindle deviating from a straight line in such a way that the core material or the resultant yarn engages a rotary end of at least one of the spindles. Wrap spinning apparatus for this purposes comprises a number of hollow spindles, at least two of which are each constructed to carry a package of wrapper yarn and have a drive for rotating at least part of the spindle, the spindles being arranged in series so that core material or the resultant wrapping yarn can pass from the exit of one to the entrance of the next and the apparatus is so constructed that the path of core material between a point just before the entrance of the first spindle and the exit of the last spindle deviates from a straight line in such a way that the core material or the resultant yarn engages a rotary end of at least one of the spindles.

The engagement of the core material or the resultant yarn with the rotary end of at least one of the spindles applies false twist which will extend to at least the first but usually to all of the wrapping points. Generally speaking, only two spindles carrying respective packages of wrapper yarn will be necessary, but one or more additional spindles may be included if required. Such additional spindles may each apply a further winding of wrapper yarn for further strengthening of the final product, but this may not be required and any additional spindle may serve merely for the application of false twist and may thus not carry a package of wrapper yarn. In addition to applying false twist itself, the presence of any additional spindle may cause the core material or yarn to be brought into engagement with the rotary end of one of the package-carrying spindles. Any additional spindle may be mounted either before or after the basic pair of package-carrying spindles, or it may be mounted between them.

When using the basic arrangement of two spindles, the deviation of the path through them preferably results from relative displacement between them. This displacement may be either angular or transverse, that is to say the spindles may be supported so that their axes are displaced or displaceable in relation to one another. It is, however, also possible to obtain a devious path if the axes of the two spindles are in line and one or more control members are included between the adjacent ends of the spindles. When using spindles which are supported so that their axes are displaceable in relation to one another, adjustment of the relative displacement causes a corresponding adjustment of the degree of false twist applied and may also be used to control the number of points at which the core material or the resultant yarn engages a spindle or spindles.

The relative displacement of the two spindles will normally be kept constant during operation, that is to say during the production of any particular package of yarn. Alternatively, however, the relative displacement of the spindles may be arranged to vary throughout the operation of the machine so as to produce a corresponding variation along the length of yarn in a package.

In theory, a pair of fixed spindles may be used, but in practice it is usually necessary for the mounting of each spindle to be movable to allow for the doffing of an empty centre for a package of wrapper yarn and its replacement by a full package and the movement necessary for doffing may also provide the adjustment of the relative displacement between the two spindles. It will thus be understood that apparatus in accordance with the invention is capable of producing a wide variety of double-wrapped yarns which may or may not also include one or more effect components.

After leaving the last of the spindles the resultant yarn is wound into a package which is normally preceded by a take-up roller or rollers. Generally speaking, these take-up rollers will run at substantially the same speed as delivery rollers preceding the arrangement of spindles and feeding core material to the entrance of the first spindle. In practice, the take-up rollers may need to have a slight lead over the delivery rollers so as to maintain a slight degree of tension in the core material and resultant yarn, thus avoiding any possible slack. If the take-up rollers are given a somewhat greater lead over the delivery rollers, the tension is increased accordingly and the characteristics of the resultant yarn are correspondingly affected. If the lead is increased still further, a degree of drafting of the core material or the yarn can be caused to occur and to prevent this being concentrated in the length prior to the first wrapping point, the delivery rollers need to be arranged close to the entrance to the first spindle, the shorter the fibre-length, the closer the spacing required.

Under some circumstances, it may be desirable for the tension to differ between the first and the second or subsequent wrapping points. For this purpose an intermediate pair of rollers may be included between the first spindle and the take-up rollers and preferably between the two spindles if there are only two. By appropriate adjustment of the speeds of the delivery rollers, the intermediate rollers and the take-up rollers, a variety of different conditions can be obtained. In particular, the core material may be held under tension at the first wrapping point and may be relatively relaxed at the second or subsequent points, or the core material may be relatively relaxed at the first wrapping point and held under tension at the second or last wrapping point.

Yet again, the difference in speed either between the delivery rollers and the intermediate rollers or between the intermediate rollers and the take-up rollers may be sufficiently great to cause drafting to occur. If drafting is required between the delivery rollers and the intermediate rollers, it is desirable, as with the example mentioned previously, that the delivery rollers should be arranged close to the entrance to the first spindle to ensure that the drafting does not all occur over the length prior to the first wrapping point. If the intermediate rollers are arranged between the last spindle and the take-up rollers, the drafting can take place without affecting the tension at any wrapping point. The different permutations and combinations of relaxation, tension and drawing over the respective reaches all give rise to different characteristics in the resultant yarn.

If a second pair of intermediate rollers is included, drafting without affecting the tension at any wrapping point may be brought about between any pair of spindles. For example, two pairs of intermediate rollers may be included between the first and second spindles. By appropriate adjustment of the speed of the delivery rollers and take-up rollers, the first wrapping may occur under any required tension, drawing then occurs before passing to the second wrapping point and the second stage of wrapping occurs under any desired tension which is quite independent of that applied during drawing.

Examples of apparatus operating in accordance with the invention will now be described with reference to the accompanying drawings, in which:

FIG. 1 is a perspective view showing details of the mechanical arrangement; and FIGS. 2 to 7 are similar diagrammatic views illustrating different degrees of displacement of the axes of the two spindles also forming part of the apparatus shown in FIG. 1.

Turning first to FIG. 1, sliver 1 is shown entering a conductor 2 leading to the nip of a double apron draft-control arrangement indicated generally as 3, from where it passes to a pair of front drafting delivery rollers 4. From there, the sliver passes in succession through a pair of hollow rotary spindles 8 and 9, each of which carries a package of wrapper yarn, 10 and 11 respectively. After leaving the spindle 11, the resultant wrapped yarn passes to take-up rollers 27 before being wound into a package.

The spindle 8 is mounted on a bracket 14 which is pivoted about a support shaft 15 and can be secured in any one of a range of angular positions by means of a bolt 16 projecting through an arcuate slot 18 in a plate 17 fixed to the bracket 14 and through a fixed plate 19. The bracket 14 is locked in any desired angular position by tightening a nut 20 on the bolt 16 so as to lock the plate 17 to the fixed plate 19. Rotary drive to the shaft 8 is provided by a belt 21 in the usual way.

The spindle 9 has a similar mounting including a bracket 14' pivoted on a support shaft 15' and is locked in any desired angular position by means of a nut 20' on a bolt 16' working in an arcuate slot 18' and passing through the same fixed plate 19. Rotary drive is provided by a belt 21'.

The angular displacement between the axes of the two rotary spindles 8 and 9 can be seen from the drawing and, as a result of this, the core material constituted by the sliver 1 engages the exit end of the spindle 8 at 25 and the exit end of the spindle 9 at 26, from where it passes to the take-up rollers 27. The effect of the engagement with the rotary spindle at the points 25 and 26 applies false twist to the sliver 1 which extends back as far as the nip of the rollers 4 so that below these rollers the sliver 1 is shown in twisted form. The path of the sliver 1 and of the resultant yarn as just described is illustrated in diagrammatic form in FIG. 2, to which reference will now be made in order to describe the method of wrap spinning involved. This Figure includes a diagrammatic showing of the resultant yarn to an enlarged scale at two spaced regions following the respective wrapping points. The various parts are identified in FIG. 2 by the same reference numerals as in FIG. 1.

Engagement of the sliver 1 at the point 25 produces false twist which, as previously described, will generally run back as far as the nip of the rollers 4. It is not essential that the false twist should extend back as far as this, but only that it should extend as far back as the point at which the core is wrapped by wrapper yarn from the package 10, this point being shown as 30. After passing the point 25, the sliver 1 enters the spindle 9 without engagement at the entry end and then engages the exit end of this spindle at 26 as previously described.

In the particular example under consideration, the spindle 9 is rotating in the opposite direction from the spindle 8 so that wrapper yarn from the package 11 is wrapped with a reverse helix to that from the package 10, the actual wrapping point being indicated as 31. In the absence of the spindle 9, false twist applied at the point 25 would gradually disappear from the core material, but engagement at the point 26 with the oppositely rotating spindle 9 accelerates the disappearance of the false twist and, as a result, the sliver at the point 31 is somewhat more opened up than it would otherwise have been at the time of application of the second wrapper yarn. By individual adjustment of the angular positions of the two spindles 8 and 9, the degree of false twist applied at the points 25 and 26 may be adjusted in relation to one another, thus providing relative adjustment of the degree of twist present at the two wrapping points 30 and 31, thus making consequent minor adjustments in the characteristics of the resultant yarn.

Figure 3:
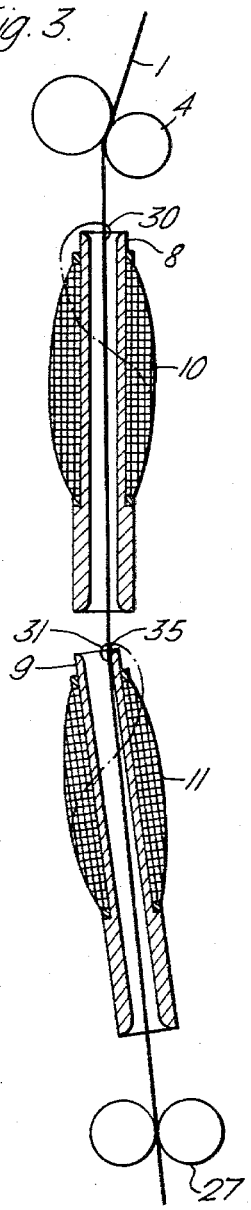

FIG. 3 illustrates the apparatus adjusted in such a way that there is no contact at all between the core material 1 and the upper spindle 8, but the core material engages the lower spindle 9 at its entry end as indicated at 35.

The falst twist produced at this point runs back past both the lower wrapping point 31 and the upper wrapping point 30 and the degree of twist at these two points does not differ to any major extent. Consequently, both helices are wound on core material in much the same condition of twist and, as in the arrangement illustrated in FIG. 2, one helix will normally be the reverse of the other so as to give a cross-over helix.

Figure 2:
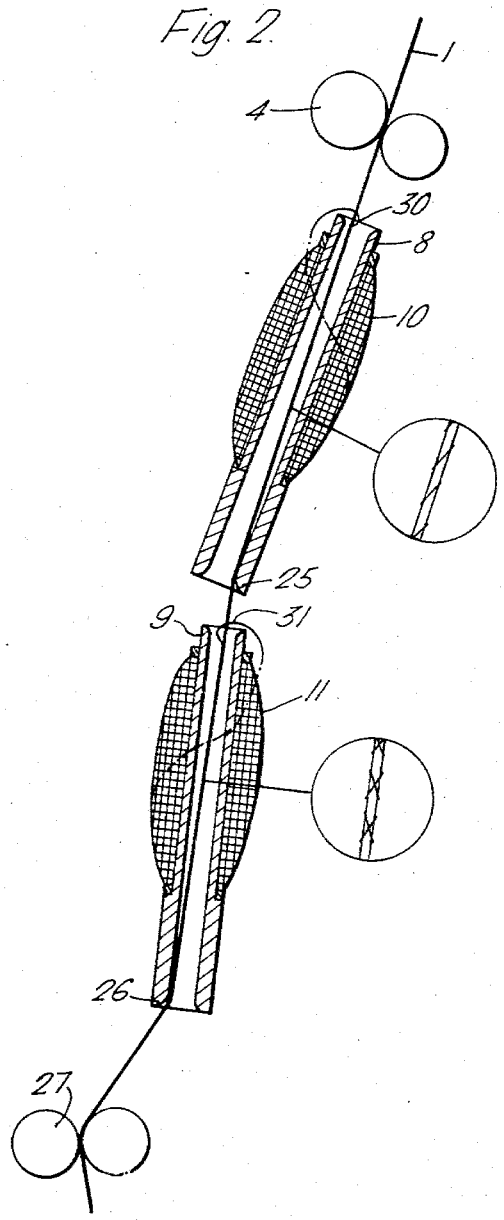
Figure 4:
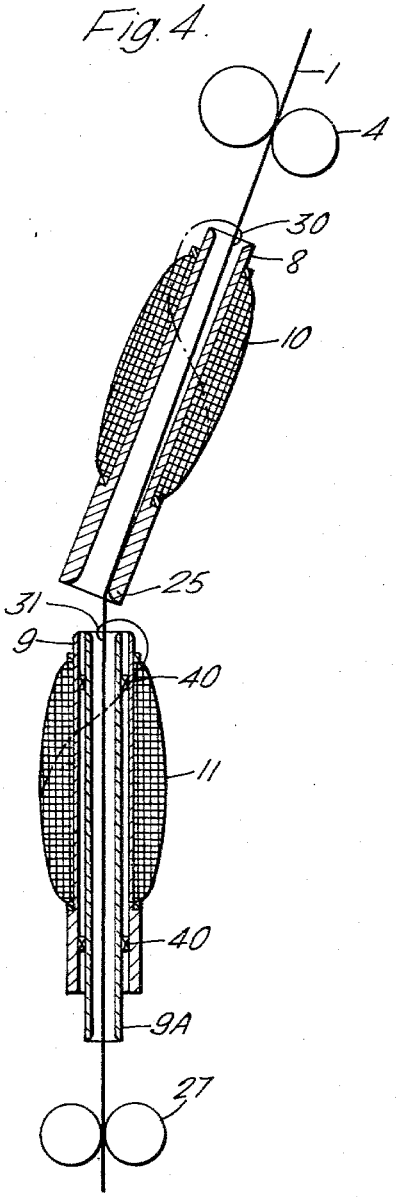

In the arrangement of FIG. 4, the upper spindle 8 is adjusted to the same general angular position as in FIGS. 1 and 2 so that there is engagement with the core material at the point 25. The lower spindle is adjusted to an angular position such that there is no contact at all with the core material and the construction of the lower spindle itself is modified, the spindle being fitted with a stationary inner sleeve 9A on which the spindle 9 runs on bearings 40. The presence of the stationary inner sleeve ensures that even if there is accidental contact between the core material and the sleeve at any point, the state of the false twist in the yarn will not be affected and furthermore the second wrapper yarn may pass freely around the core yarn since the core is in line with the axis of the second spindle and hence does not engage the spindle wall at the wrapping point. As illustrated, the wrapper yarn from the package 11 engages the edge of the stationary sleeve 9A and to avoid this, the sleeve may be made somewhat shorter than illustrated so that the engagement is between the wrapper yarn and the edge of the spindle 9 which is, of course, rotating at the same speed as the wrapper yarn itself.

Figure 5:
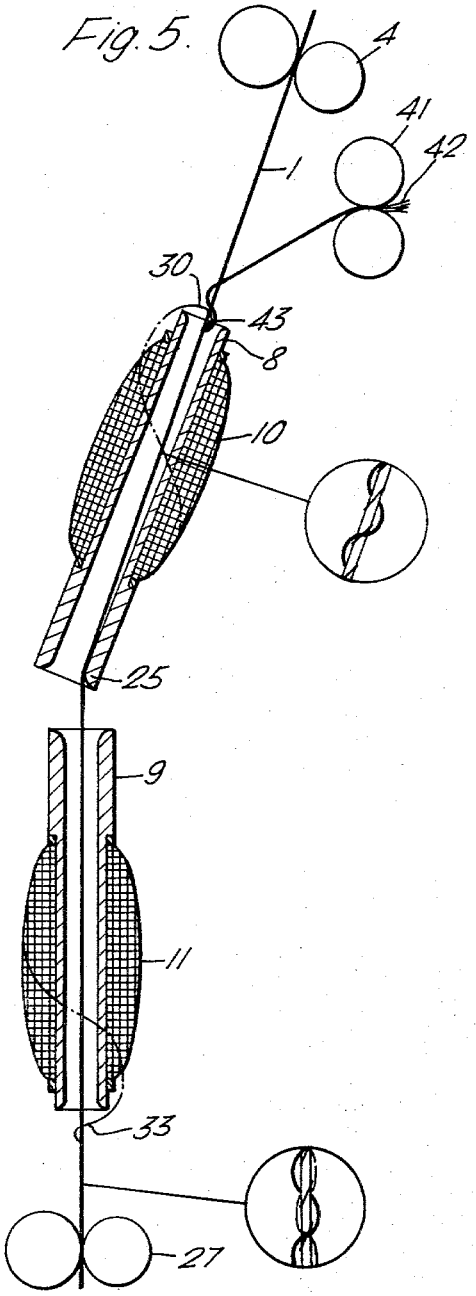
Figure 6:
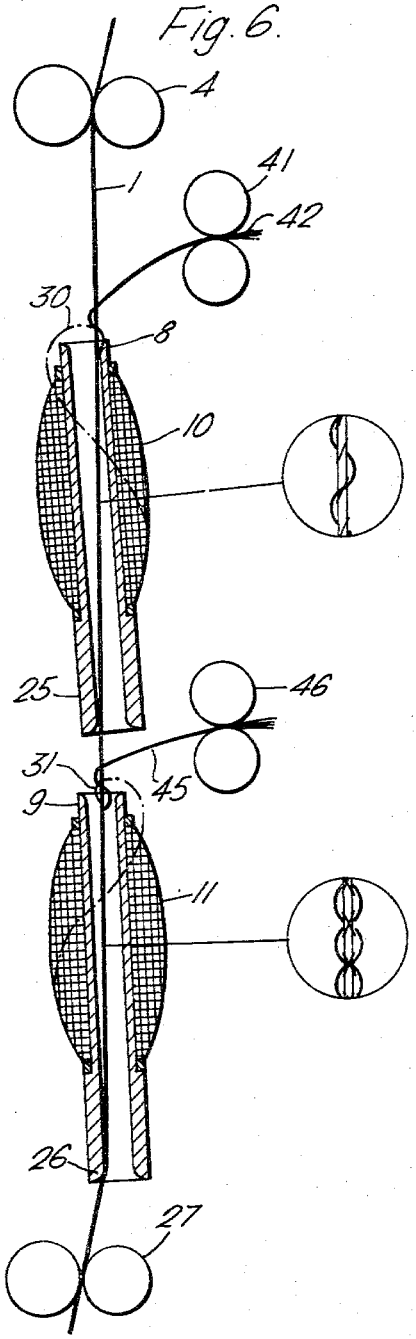

The arrangements so far referred to have illustrated the production of a straightforward core yarn. It will, of course, be understood that any of these arrangements may equally well be used for the production of an effect yarn merely by over-feeding effect material alongside the core material through the two spindles. FIG. 5 illustrates such an arrangement specifically, an additional pair of feed rollers being shown for overfeeding effect material 42 in a direction transverse to that of core material 1 so as to join the latter at a point shown as 43. The relative arrangement of the two spindles 8 and 9 is similar to that illustrated in FIG. 4 and engagement at the point 25 produces a false twist which runs back at least as far as the point 43 so that the over-fed effect material 42 is wrapped around the core material 1 before reaching the first wrapping point 30. As in FIG. 2, there is a diagrammatic showing, to an enlarged scale, of the yarn at two regions following the wrapping points.

A modification of this arrangement is that the wrapper yarn from the package 11 is caused to wrap the single wrapped yarn beyond the exit end of the spindle 9 at a point indicated as 33. As a consequence, the single-wrapped effect yarn from the upper spindle 8 passes generally along the axis of the spindle 9. There will be no significant engagement of the yarn with the inner surface of the spindle 9 other than that which might be caused by the protrusion of the effect component or by possible ballooning of the yarn as it passes through the spindle 9, but if this proves to be in any way disadvantageous, the spindle 9 may be fitted with a stationary inner sleeve 9A in the same way as illustrated in FIG. 4.

In all the examples so far described, it has been assumed that the core material 1 is a sliver although, as explained originally, various other types of core material may be used if desired. The arrangement of FIG. 6 may be of particular benefit for use with a core material 1 in the form of a rove and the angular position of the two spindles 8 and 9 is such that the yarn engages both the entry end of the spindle 8 at 34 and the exit end at 25 and also engages the exit end of the spindle 9 at 26. Effect material 42 is overfed by feed rollers 41 as in FIG. 5 and is wrapped at the point 30. A second effect material 45 is overfed by feed rollers 46 at a point between the two spindles 8 and 9 and is then wrapped at 31 so as to be combined with the single wrapped effect yarn emerging from the lower end of the spindle 8.

The engagement at the upper end 34 and the lower end 25 of the spindle 8 avoids the application of too severe a degree of friction to the core material thus avoiding risk of unduly upsetting or scuffing it in order to produce the necessary degree of false twist. Thus the engagement at the two points 34 and 25 means that the degree of deflection of the rove forming the core material 1 can be reduced, thus reducing the actual frictional contact with any one portion of the spindle. After wrapping with the second wrapper yarn at the point 31, the resultant yarn can withstand a greater degree of contact thus allowing the frictional contact at the point 26 at the exit of the spindle 9 to be increased. This will also mean that the wrapping configuration of the effect material 45 will differ from that of the effect material 42, this being shown diagrammatically at two spaced regions as in previous Figures.

Figure 7:
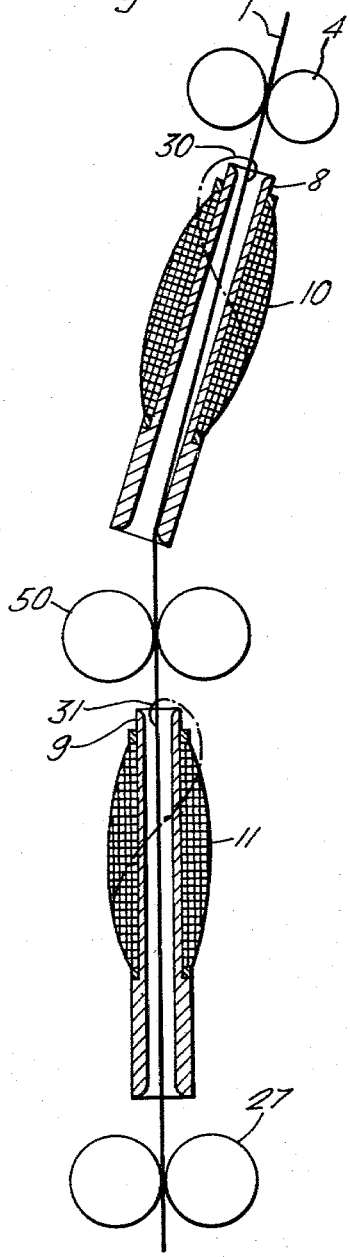

The modified apparatus of FIG. 7 includes an intermediate pair of rollers 50 arranged between the spindles 8 and 9. Apart from this, the remainder of the apparatus is as shown in the first three Figures and the path of the core material and resultant yarn is as shown in FIG. 4. In other words, there is engagement with the rotary lower end 25 of the spindle 8, following which the yarn passes through the spindle 9 without any contact. The effect of the intermediate rollers 50 depends on their speed of rotation and, in particular, the relationship between the speed of these rollers and the delivery rollers 4 on the one hand and between the rollers 50 and the take-up rollers 27 on the other hand. As explained earlier, in the absence of the rollers 50, the take-up rollers 27 are most usually given a slight lead over the delivery rollers 4 so as to keep the core material and resultant yarn taut during successive stages of wrapping.

An increased lead increases the tension accordingly and may lead to drafting of the core material. The apparatus shown in FIGS. 1 to 6 is not designed for such drafting to occur, since generally speaking, the delivery rollers 4 are too far from the entrance of the spindle 8. In the apparatus of FIG. 7, however, it will be seen that the delivery rollers 4 are mounted appreciably closer to the entrance to the spindle 8 so that if the rollers 50 are given sufficient lead over the rollers 4, drafting will take place in the region of the wrapping point 30.

The main advantage of the inclusion of the rollers 50 is that the tension can be adjusted independently over the two reaches between the rollers 4 and 50 and the rollers 50 and 27 respectively. In this way, the wrapping at one of the points 30 or 31 can be carried out under tension in the core material or yarn while that at the other can be carried out under relaxed conditions. Appropriate increase of the tension over either reach will lead to drafting.

As an alternative to arranging the rollers 50 between the two spindles 8 and 9, they can be arranged after the spindle 9 and before the rollers 27. With this arrangement, it is not possible to adjust the tension independently at the two wrapping points, but it is possible to draft the yarn after the completion of wrapping without affecting the wrapping operation in any way. If it is desired to carry out the drafting without affecting the wrapping action and while still allowing independent adjustment of the tension at the two wrapping points, it is necessary to fit two pairs of intermediate rollers between the spindles 8 and 9. Adjustment of the speed difference between the rollers 4 and the first pair of intermediate rollers 50 controls the tension at the first wrapping point 30, the yarn is then drafted between the two pairs of intermediate rollers and adjustment of the relative speeds of the second pair of intermediate rollers and of the take-up rollers 27 then controls the tension at the second wrapping point 31.

From the examples just given, it is possible to appreciate the extreme versatility of the apparatus and the process involved. These examples represent only a relatively small proportion of the possible permutations, any of which can be used for the production either of a basic, double-wrapped core yarn or of a double-wrapped effect yarn. Not only can the appearance of the yarn be adjusted by selection of the number of contact points with the two spindles, but the degree of contact at any one of the points can also be adjusted by appropriate adjustment of the angle of the spindle in question. Further control is possible by adjustment of the tension at the respective wrapping points and by inclusion of a degree of drafting, if desired.

Reference has already been made to the possibility of adjusting the axes of the two spindles in a transverse direction rather than angularly and it is also possible for the apparatus to be modified so as to allow for the possibility of adjustment in a generally axial direction so as to vary the spacing between the two spindles. For example, if the second wrapping point 33 is below the lower spindle 9, the adjacent ends of the two spindles may be virtually touching. As previously mentioned, the two spindles may rotate in opposite directions or in the same direction and a further variation may be achieved by adjusting the speeds of the spindles in relation to one another. Thus each spindle may rotate at a different fixed speed or the speed of one or both the spindles may be adjusted during the actual operation of the machine. Also as previously mentioned, one or more further spindles can also be included and may not necessarily carry any wrapper yarn. In addition to the false twist provided by engagement with one or more points on either or both spindles, a separate false twist device may be included if desired.

We claim:

1. A method of producing core yarn wrapped with at least two separate wrapper yarns, comprising the steps of passing core material along a path passing in succession through a plurality of rotary hollow spindles, each spindle having an entrance and an exit, wrapping said core material with at least two wrapper yarns withdrawn from packages carried by respective rotary spindles, said wrapping resulting from rotation of said respective spindle, and causing said path of said core material between a point just before said entrance of the first spindle and said exit of the last spindle to deviate from a straight line in such a way that said material engages a rotary end of at least one of said spindles, whereby to apply false twist.

2. A method according to claim 1 wherein said core material is passed in succession through only two spindles.

3. A method according to claim 2 wherein relative angular displacement is provided between said two spindles whereby to produce said deviation of said path.

4. A method according to claim 2 wherein relative transverse displacement of said spindles is provided whereby to provide deviation of said path.

5. A method according to claim 3 or claim 4 including keeping said relative displacement of said two spindles constant during operation.

6. A method according to claim 1 wherein said core material is fibrous, said material being fed to said entrance of said first spindle by delivery rollers and taken from said exit of said last spindle by a take-up roller, the speed of said take-up roller in relation to the speed of said delivery rollers being sufficient to cause drafting of said core material.

7. A method according to claim 1 in which said core material is fibrous, said core material being fed to said entrance of said first spindle by delivery rollers and being taken from said exit of said last spindle by a take-up roller, said core material being controlled between said exit of said first spindle and said take-up roller by a pair of intermediate rollers, the speed of said intermediate rollers in relation to the speed of said delivery rollers being sufficient to cause drafting of said core material.

8. A method according to claim 1 in which said core material is fibrous, said core material being fed to said entrance of said first spindle by delivery rollers and being taken from said exit of said last spindle by a take-up roller, said core material being controlled between said exit of said first spindle and said take-up roller by a pair of intermediate rollers, the speed of said intermediate rollers in relation to the speed of said take-up roller being sufficient to cause drafting of said core material.

9. Apparatus for producing core yarn wrapped with at least two separate wrapper yarns comprising a plurality of hollow spindles, means on at least two of said spindles adapted to carry a package of wrapper yarn, means for providing rotary drive to at least part of each said spindle having wrapper yarn package supporting means and means supporting said spindles in relation to one another whereby said core material can pass through said spindles in succession along a path which deviates from a straight line between a point just before the entrance of the first spindle and a point just beyond the exit of the last spindle, said deviation being such that said core material engages a rotary end of at least one of said spindles.

10. Apparatus according to claim 9 including only two rotary spindles, each said spindle having means for carrying a package of wrapper yarn.

11. Apparatus according to claim 10 including means supporting said spindles in such a way that the axes of said spindles are displaced in relation to one another.

12. Apparatus according to claim 10 including means supporting said spindles in such a way that the axes of said spindles are displaceable in relation to one another.

13. Apparatus according to claim 12 wherein said support means comprises a support shaft, a mounting capable of angular displacement about said support shaft and means for securing said mounting in a desired angular position.

14. Apparatus according to claim 9 and including means for feeding core material to said first spindle.

15. Apparatus according to claim 14 and also including means for overfeeding effect material in relation to said core material.

16. Apparatus according to claim 14 wherein said means for feeding core material to said first spindle comprises a pair of delivery rollers, said apparatus also including a take-up roller following said last spindle and a pair of intermediate rollers between the exit of said first spindle and said take-up roller.

* * * * *